US009101217B2

(12) United States Patent
Bay

(10) Patent No.: US 9,101,217 B2
(45) **Date of Patent: *Aug. 11, 2015**

(54) ERGONOMIC GÖBELEK CHAIR

(71) Applicant: Araz Bay, San Diego, CA (US)

(72) Inventor: Araz Bay, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/584,353

(22) Filed: Dec. 29, 2014

(65) Prior Publication Data

US 2015/0108803 A1 Apr. 23, 2015

Related U.S. Application Data

(62) Division of application No. 13/837,545, filed on Mar. 15, 2013, now Pat. No. 8,919,881.

(51) Int. Cl.

| | |
|---|---|
| ***A47C 3/00*** | (2006.01) |
| ***A47C 7/40*** | (2006.01) |
| ***A47C 7/54*** | (2006.01) |
| ***A47C 9/00*** | (2006.01) |
| ***A47C 3/20*** | (2006.01) |
| ***A47C 7/00*** | (2006.01) |

(52) U.S. Cl.

CPC ... *A47C 3/00* (2013.01); *A47C 3/20* (2013.01); *A47C 7/004* (2013.01); *A47C 7/006* (2013.01); *A47C 7/402* (2013.01); *A47C 7/543* (2013.01); *A47C 9/002* (2013.01)

(58) Field of Classification Search

CPC ..... A47C 3/20; A47C 3/30; A47C 9/00; A47C 4/54; A47C 7/14; A47D 1/002; A47D 1/02; A61G 5/14; B60N 2/02

USPC ..... 297/195.11, 338, 337, 452.41, 311, 297/411.34, 354.13

See application file for complete search history.

(56) References Cited

U.S. PATENT DOCUMENTS

| | | | | |
|---|---|---|---|---|
| 4,438,919 | A | 3/1984 | Gamzo | |
| 5,390,979 | A * | 2/1995 | Corlett | 297/344.12 |
| 5,522,772 | A | 6/1996 | Chenard et al. | |
| 5,547,253 | A | 8/1996 | Schwartz et al. | |
| 5,590,930 | A | 1/1997 | Glockl | |
| D381,574 | S | 7/1997 | Kruszka | |
| 5,690,389 | A | 11/1997 | Ekman et al. | |
| 5,833,587 | A | 11/1998 | Strong et al. | |

(Continued)

FOREIGN PATENT DOCUMENTS

FR 2859640 A1 9/2003

*Primary Examiner* — Jose V Chen

(74) *Attorney, Agent, or Firm* — Gary L. Eastman, Esq.

(57) ABSTRACT

The present invention includes an ergonomic chair that is useful for people who sit for an extended period of time at work, in avoiding work station related back pain and neck pain. The present invention incorporates a hemispherical seat which can be locked in position and comprises a fixed inner hemisphere, a movable outer hemisphere, and a shroud. The support pole where the inner hemisphere is bolted into absorbs the load from the user, and the outer hemisphere equipped with hydraulic or pneumatic resistance devices and attached to the tension springs provides a balanced movement of the chair. Accordingly, while sitting on the chair, the present invention allows no deformation on the rigid hemispherical seat, and keeps the spine of the user in a desirable alignment, further improving the internal function of the user's organs. The present invention can also be used as an office stretch GYM ball.

20 Claims, 15 Drawing Sheets

(56) References Cited

U.S. PATENT DOCUMENTS

| | | | | |
|---|---|---|---|---|
| 5,909,925 | A | 6/1999 | Glockl | |
| 6,070,943 | A | 6/2000 | Guery-Strahm | |
| 6,390,559 | B1 | 5/2002 | Schnitzhofer | |
| 6,447,070 | B1 | 9/2002 | Ekman et al. | |
| 6,461,284 | B1 * | 10/2002 | Francavilla | 482/142 |
| 6,520,578 | B1 * | 2/2003 | Jospa et al. | 297/217.1 |
| D471,025 | S | 3/2003 | Chiu | |
| 6,575,885 | B1 | 6/2003 | Weck et al. | |
| 6,616,238 | B1 | 9/2003 | Guery-Strahm | |
| 6,730,005 | B1 | 5/2004 | Liao | |
| 6,740,008 | B1 | 5/2004 | Ho et al. | |
| 6,832,817 | B1 | 12/2004 | Chiu | |
| 7,044,542 | B2 | 5/2006 | Muscat | |
| 7,044,558 | B2 | 5/2006 | Chiu | |
| D536,542 | S | 2/2007 | Chiu | |
| 7,476,189 | B2 * | 1/2009 | Hale | 482/142 |
| 7,588,522 | B2 | 9/2009 | Heitzman | |
| 8,056,976 | B1 | 11/2011 | Polk | |
| 8,231,175 | B2 * | 7/2012 | Aminian | 297/314 |
| 8,235,878 | B2 * | 8/2012 | Signorile et al. | 482/142 |
| 8,708,407 | B2 | 4/2014 | Marino | |
| 8,721,005 | B2 * | 5/2014 | Mankin | 297/452.41 |
| 8,919,881 | B2 * | 12/2014 | Bay | 297/311 |
| 2006/0040808 | A1 | 2/2006 | Riazi | |
| 2010/0314916 | A1 | 12/2010 | Walser | |
| 2012/0299357 | A1 * | 11/2012 | Newman | 297/452.41 |
| 2013/0334846 | A1 * | 12/2013 | Bahneman et al. | 297/195.11 |

* cited by examiner

ERGONOMIC GÖBELEK CHAIR

RELATED APPLICATIONS

This application is a divisional of U.S. patent application Ser. No. 13/837,545 for an "Ergonomic Göbelek Chair" filed on Mar. 15, 2013, and currently co-pending.

FIELD OF THE INVENTION

The present invention pertains generally to an ergonomic chair that improves strength, endurance, and flexibility of the user. The present invention is more particularly, though not exclusively, useful as a chair which is designed to avoid work station related back pain and neck pain for people sitting for a long period of time at work by adopting a dynamic hemispherical seat to allow the harmony of the spine, muscles, ligaments, and discs. The present invention also provides an ergonomic chair that can be used as an office stretch GYM ball, when a back support and folding hinges are folded under the chair.

BACKGROUND OF THE INVENTION

Recent studies show that many cases of back pain and neck pain in a modern society are related to work stations that require people to sit for an extended period of time, since the human spine is not originally designed to sit for more than 10 to 15 minutes. Sitting for a long period of time puts a lot of strain on discs of the lumbar, or lower back, and the pressure on the discs increases dramatically when people lean forward while sitting, to write or use a computer. This bad posture exerts uneven forces to the intervertebral discs that lie between each of the vertebral bodies, and results in a loss of anterior longitudinal ligaments.

It has been known that a majority of back pains are caused by strains and/or sprains of the lordotic curve consisting of muscles, ligaments and tendons. People with jobs that require sitting at a work station for a long period of time tend to have their muscles become lax and lose the ability to support the spine correctly, due to the stress on the cervical spine. As a result, the ligaments and tendons in such people can also lose the ability to function properly. Unfortunately, sitting on a regular chair at work does not usually support the lordotic curve, and thus, various types of ergonomic chairs have been developed.

Ergonomic seating units adopting a gas-filled ball or a balloon which allows lateral movement and deformation when a user sits on the chair have been invented and widely used. These ergonomic chairs may be helpful to adjust sitting comfort, balance, and endurance. However, people on the ball-shaped chairs tend to forget about their sitting posture during work and currently available ergonomic chairs include seats which deform to accommodate the users poor posture. Thus, currently available ergonomic chairs are not able to properly maintain the user's posture upright. The currently available ergonomic chairs can support the user's back only when the user leans on the chair, but not when the user leans forward towards the desk to write or type on the computer.

In light of the above, it would be advantageous to provide an ergonomic chair that can subconsciously adjust the user's position for a better posture as the user sits, by maintaining the spine of the user in the same alignment as when the user stands. It would also be advantageous to provide an ergonomic chair with a seat which does not allow any deformation on the seat. It would further be advantageous to provide an ergonomic chair that helps the nerve system to transmit 100% of the signals to the user's organs for a better internal function, through the correct posture. In addition, it would be advantageous to provide an ergonomic chair that can be used as a stretch GYM ball at the office, and which is simple to use, and comparatively cost effective.

SUMMARY OF THE INVENTION

The present invention includes an ergonomic chair that improves strength, endurance, and flexibility of the user. The present invention is useful for people who sit for an extended period of time at work and minimizes work station related back pain and neck pain. The present invention incorporates a hemispherical seat which can be locked in position and comprises a fixed inner hemisphere, a movable outer hemisphere, and a circumferential shroud. The inner hemisphere is fixed to a support pole which absorbs the load from the user, and a movable outer hemisphere of the hemispherical seat is positioned over the fixed inner hemisphere and attached to tension springs which maintain the movable outer hemisphere in place. The movable outer hemisphere may be equipped with elastic ends or springs having hydraulic or pneumatic resistance devices, forming a rigid frame for a balanced movement of the outer hemisphere. The rigid outer hemispherical of the present invention does not allow deformation on the hemispherical seat when a user sits on the chair and the present invention keeps the spine of the user in the same alignment as when the user stands, further improving the internal function of the users organs. Furthermore, the present invention can also be used as an office stretch GYM ball, when the folding hinges and a back support are folded and slid in under the chair.

BRIEF DESCRIPTION OF THE DRAWING

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
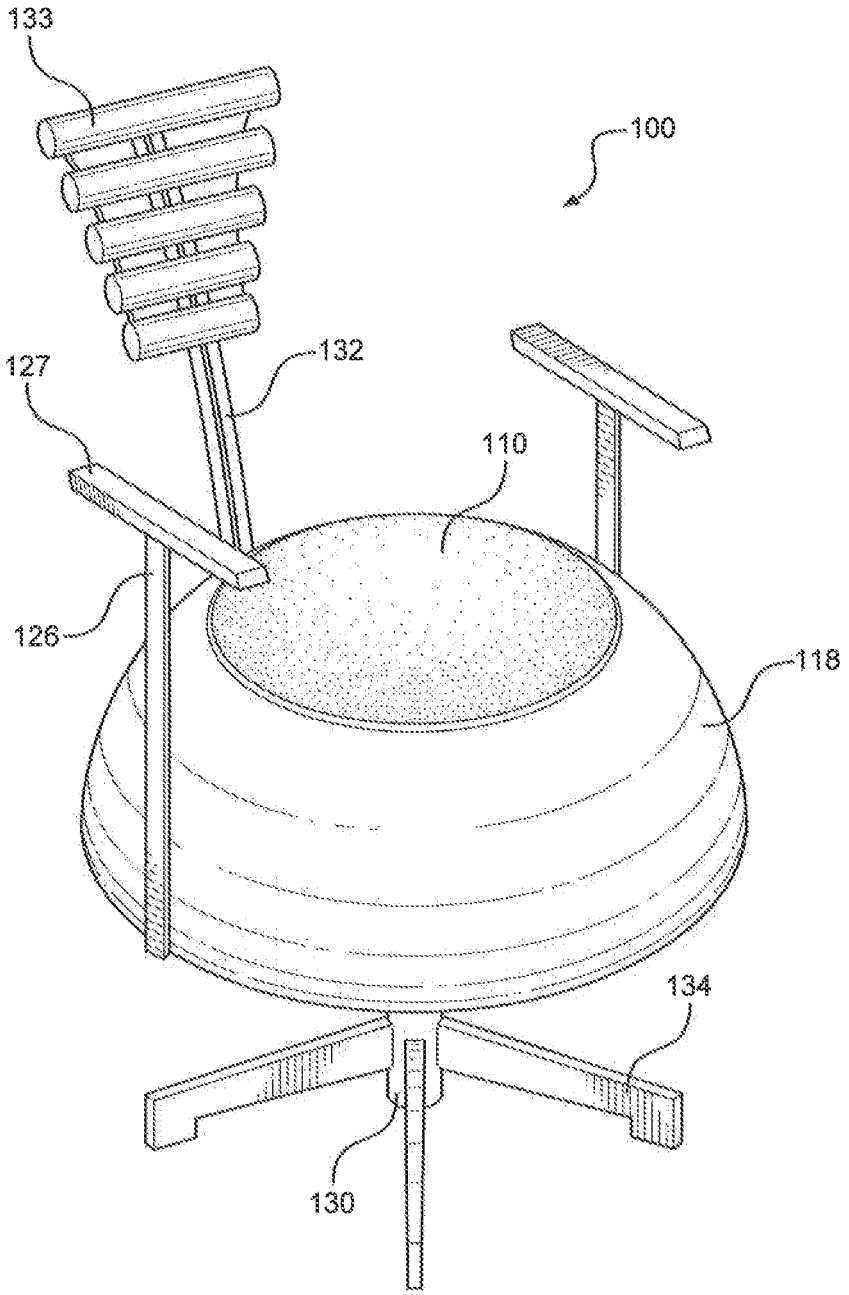
FIG. 1 is a perspective view of the Ergonomic Göbelek Chair of the present invention, showing a hemispherical seat, a pair of folding hinges having a pair of armrest supports, a back support, a base support, and a pedestal.

Referring initially to FIG. 1, a perspective view of a preferred embodiment of the Ergonomic Göbelek Chair of the present invention is depicted and generally designated 100. The preferred embodiment 100 of the Ergonomic Göbelek Chair of the present invention depicted in FIG. 1 shows a hemispherical seat consisting of multiple layers of hemispheres and a shroud 118 including a sheet of soft and breathable foam 110 attached on top of a movable outer hemisphere 108 (not shown) for the user's comfort while sitting on the chair, a pair of folding hinges 126 equipped with a pair of armrest supports 127, a back support 132, a base support 130 and a pedestal 134. A back support 132 is equipped with a lumbar cushion 133 for the user's comfort.

Figure 2:
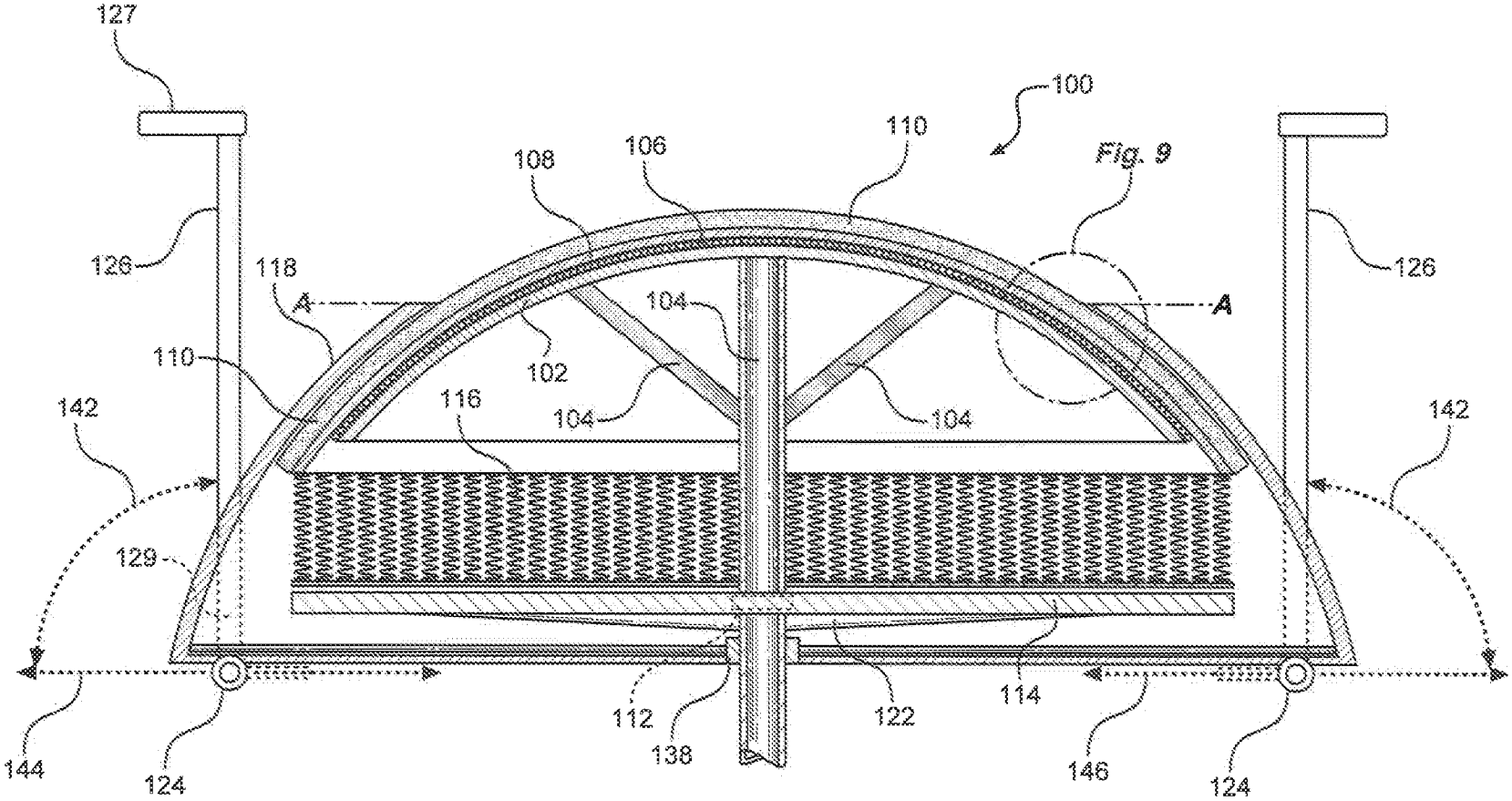
FIG. 2 is a vertical cross-sectional view of the Ergonomic Göbelek Chair of the present invention, consisting of multiple layers of hemispheres and a shroud connected through tracks of ball bearings or a sheet of soft and breathable foam, wherein an inner hemisphere is attached to the support pole, an outer hemisphere attached to a series of tension springs is freely movable while maintaining its orientation over the inner hemisphere and also can be locked in position, and a shroud encircles the outer hemisphere and is equipped with a pair of folding hinges to support a pair of armrests.

Now referring to FIG. 2, a vertical cross-sectional view of a preferred embodiment of the Ergonomic Göbelek Chair of the present invention is depicted. The preferred embodiment 100 of the Ergonomic Göbelek Chair of the present invention consists of multiple layers of hemispheres (a fixed inner hemisphere 102 and a movable outer hemisphere 108) and a shroud 118 connected through tracks of ball bearings 106 and a sheet of soft and breathable foam 110. The preferred embodiment 100 of the present invention further comprises a support pole 104, round mounting ring 112, a circular metal or plastic sheet 114, a bottom cover 140 (shown in FIG. 11), a series of tension springs 116, support bars 122, a pair of folding hinges 126 equipped with a pair of locking hinges 124 and a pair of armrest supports 127, a shock absorber 128 (shown in FIGS. 17, 18, and 19), a base support 130 (shown in FIGS. 1, 17, 18, and 19), a back support 132 (shown in FIGS. 1 and 19), a pedestal 134 (shown in FIGS. 1, 17, and 19), and a locking system 200 (shown in FIGS. 13A, 13B, 14A, 14B, 15A, 15B, 16A, and 16B).

With regard to the fixed inner hemisphere 102, a support pole 104 is secured to an inner center and sides of the fixed inner hemisphere 102, through a circular opening 138, to support the load from the user. The tracks of ball bearings 106 are permanently attached to the fixed inner hemisphere 102. The movable outer hemisphere 108 is then placed on top of the tracks of ball bearings 106. A sheet of soft and breathable foam 110 is attached on top of the movable outer hemisphere 108, and the support pole 104 is inserted into the round mounting ring 112. The outer surface of the round mounting ring 112 is attached to a circular metal or plastic sheet 114 where the movable outer hemisphere 108 is connected by a series of tension springs 116.

Through such connections, when the movable outer hemisphere 108 rotates, the series of tension springs 116 helps the circular metal or plastic sheet 114 rotate together. Indeed, the outer hemisphere 108 rotates about its center on fixed inner hemisphere 102. The tension springs 116, by allowing tension only, not compression, helps the movement of the movable outer hemisphere 108 about its center (tilts on the "Y" axis) yet maintains the orientation of the hemispherical seat during such movement. On top of the movable outer hemisphere 108, a shroud 118 having a larger diameter than those of the fixed inner hemisphere 102 and the movable outer hemisphere 108, is added covering the foam layer 110 over the fixed inner hemisphere 102, and the movable outer hemisphere 108.

The shroud 118 is used as a shell for the chair and it is horizontally cut along the line A-A in FIG. 2, leaving the top (above the line A-A) of the shroud 118 open, yet concealing the tracks of ball bearings 106 and tension springs 116. By adopting a seat consisting of multiple layers of rigid hemispheres and a rigid shroud, the present invention does not allow any deformation on the seat when a user sits on the chair. Even though a sheet of soft and breathable foam 110 is used as a cushion for the user's comfort while sitting on the chair, such a cushion forming on the foam 110 does not results in any deformation on the hemispherical seat of the chair. In addition, a support pole 104 where the fixed inner hemisphere 102 is supported absorbs the load from the user.

At the base frame of the shroud 118, the bottom cover 140 (shown in FIGS. 11 and 12) of the chair is installed and the bottom cover 140 is formed with a groove (shown in FIG. 12) to receive the outer edge of the shroud 118. The support bars 122 are attached underneath the circular metal or plastic sheet 114 and they prevent the circular metal or plastic sheet 114 from bending when the movable outer hemisphere 108 is pushed or pulled in the Y-direction by user's movement. Each of the folding hinges 126 is connected to an armrest support 127, and an extension 129 can be extended for an extra length. For each of the folding hinges 126, one end of the folding hinge 126 is locked and stands vertically, and the other end of the folding hinge 126 is unlocked. The folding hinge 126 is then folded 90 degrees out and partially slid into the rails. By moving freely both to the right and left sides, in direction of arrows 144 and 146 respectively, as depicted in FIG. 2, the folding hinges 126 connected to the armrest supports 127 can be positioned under the chair.

Figure 3:
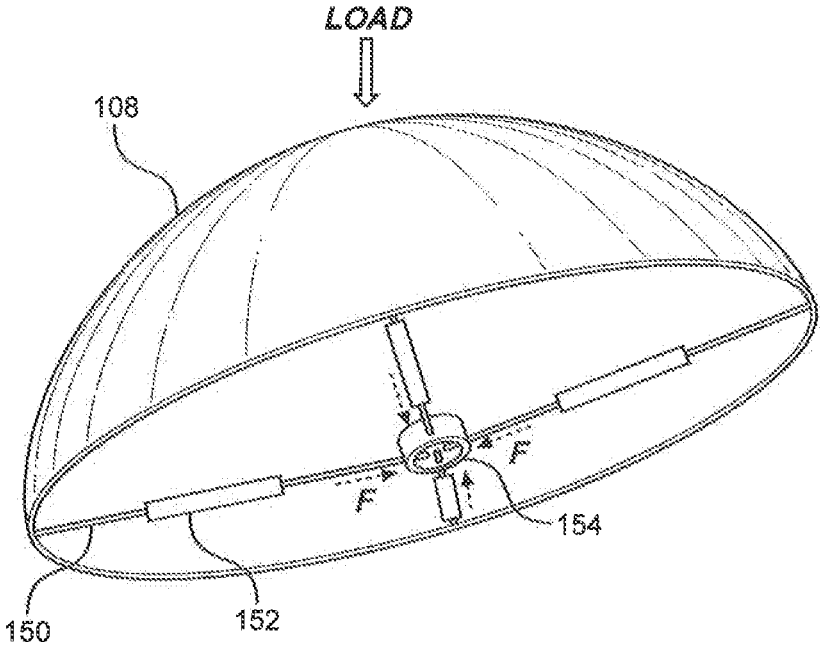
FIG. 3 is a perspective view of a movable outer hemisphere equipped with resistance elements, such as elastic ends or springs, and hydraulic or pneumatic resistance devices at its bottom, forming a rigid frame structure to the hemispherical seat.

FIG. 3 depicts a movable outer hemisphere 108 equipped with elastic ends or springs 150 and hydraulic or pneumatic resistant devices 152. The elastic ends or springs 150 equipped with hydraulic or pneumatic resistance devices 152 are connected to the hub 154. As a result, a rigid frame is created on the elastic ends or springs 150, allowing a balanced movement of the movable outer hemisphere 108 while maintaining the orientation upon the application of the load on the chair.

Figure 4:
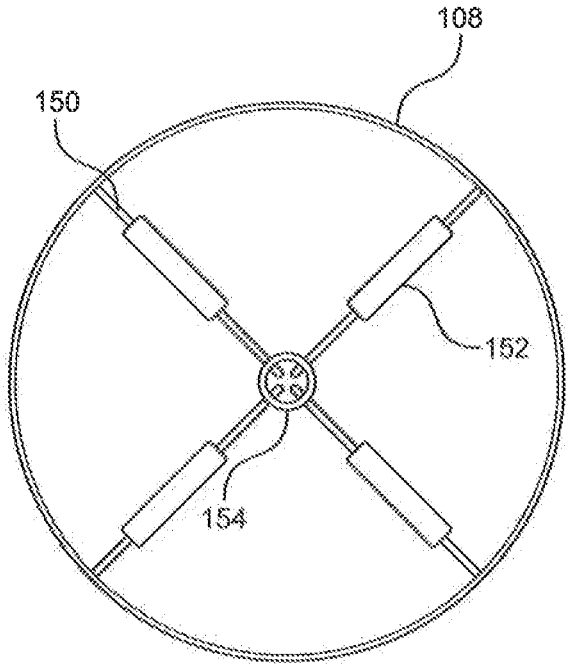
FIG. 4 is a bottom view of a movable outer hemisphere equipped with resistance elements, such as elastic ends or springs and hydraulic or pneumatic resistance devices.

FIG. 4 is a bottom view of the movable outer hemisphere 108 equipped with elastic ends or springs 150 having hydraulic or pneumatic resistance devices 152. Multiple elastic ends or springs 150 in the same length equipped with hydraulic or pneumatic resistance devices 152 are connected to the hub 154 at the center.

Figure 5:
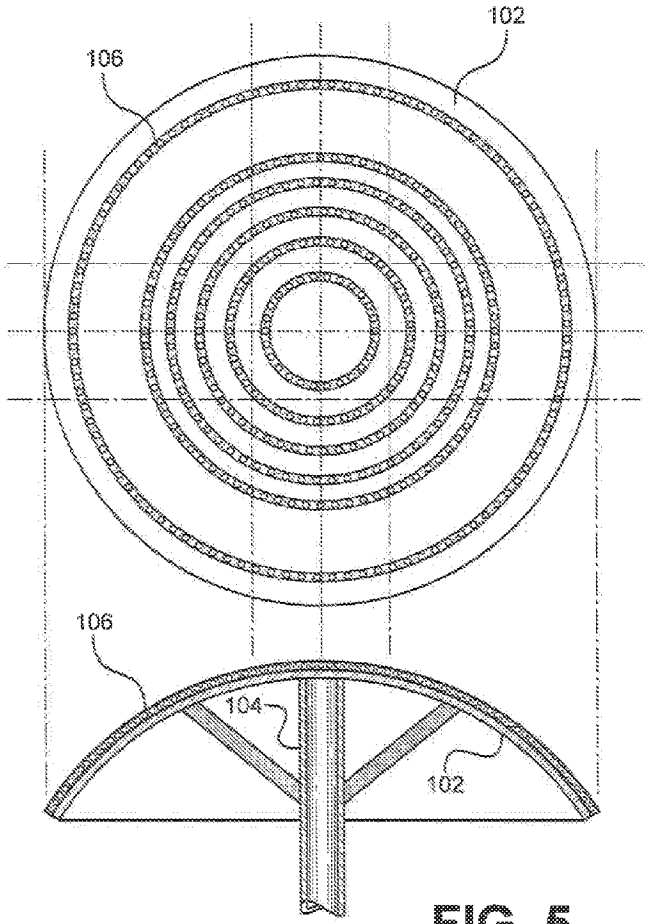
FIG. 5 is a top view of a fixed inner hemisphere permanently equipped with ball bearings placed on the circular tracks.

Referring to FIG. 5, a top view of the fixed inner hemisphere 102 permanently equipped with the ball bearings 106 on the circular tracks, is depicted. As shown in FIG. 5, in a preferred embodiment, the ball bearings 106 are placed on a series of circular tracks, on top of the fixed inner hemisphere 102.

Figure 6:
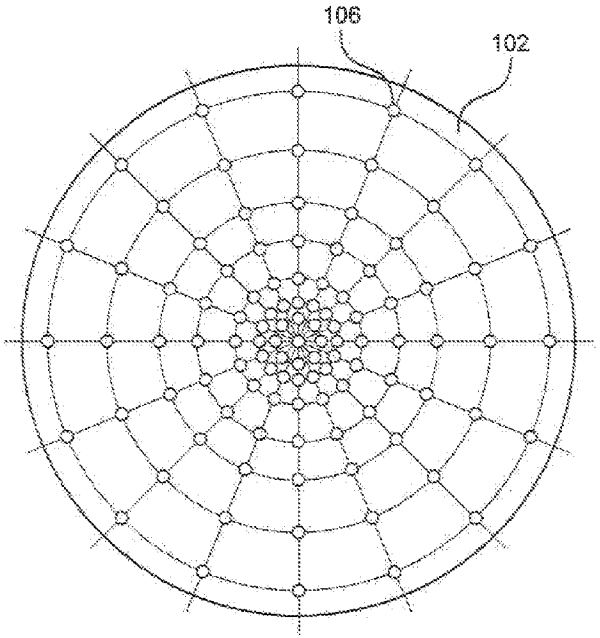
FIG. 6 is a top view of a fixed inner hemisphere permanently equipped with ball bearings, with an alternative placement on the tracks in a radial arrangement.

FIG. 6 is a top view of the fixed inner hemisphere 102 permanently equipped with the ball bearings 106 with an alternative placement. In this alternative placement, the ball bearings 106 can be placed on the tracks in a radial arrangement.

Figure 7:
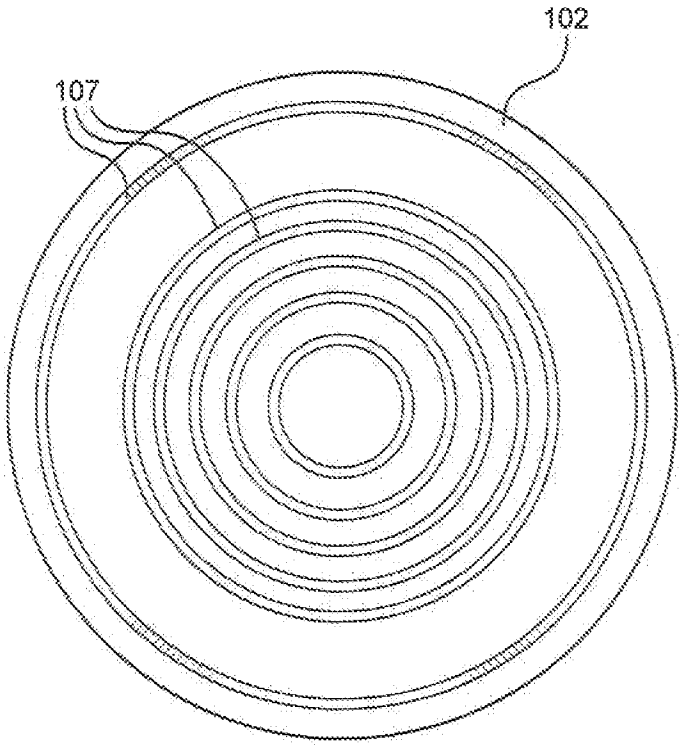
FIG. 7 is a top view of a fixed inner hemisphere with grease bearings placed on the circular tracks.

Referring to FIG. 7, the Ergonomic Göbelek Chair of the present invention can also alternatively adopt grease bearings 107. As shown in FIG. 7, the grease bearings 107 can be placed on top of the fixed inner hemisphere 102, in a series of circular arrays. Similar to the alternative arrangement for the ball bearings of FIG. 5, the grease bearings 107 can also be alternatively adopted on top of the fixed inner hemisphere 102, either on the tracks in a radial arrangement or in an orthogonal arrangement.

Figure 8:
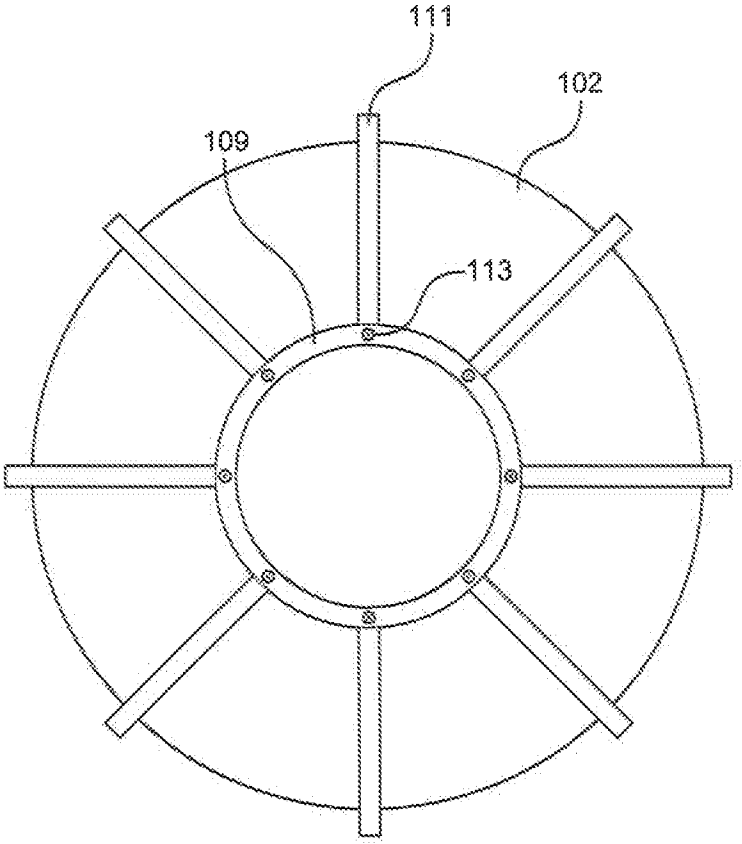
FIG. 8 is a top view of a fixed inner hemisphere with polymer bearings consisting of a circular strip on the top of the inner hemisphere, and multiple strips attached to the circular strip and extended radially therefrom.

FIG. 8 depicts a top view of the fixed inner hemisphere 102 with polymer bearings. The polymer bearing is a strip or strips made of polypropylene, polyethylene, or Delrin®, which allows metal parts to easily slide with low friction. By adopting polymer bearings, the movable outer hemisphere 108 can slide easily over the fixed inner hemisphere 102. As shown in FIG. 8, a circular strip 109 is placed at the top of the fixed inner hemisphere 102 and the ends of a number of rectangular strips 111 are screwed to the circular strip, with an aid of screws 113. A number of rectangular strips 111 are extendedly and radially positioned on top of the fixed inner hemisphere 102.

Figure 9:
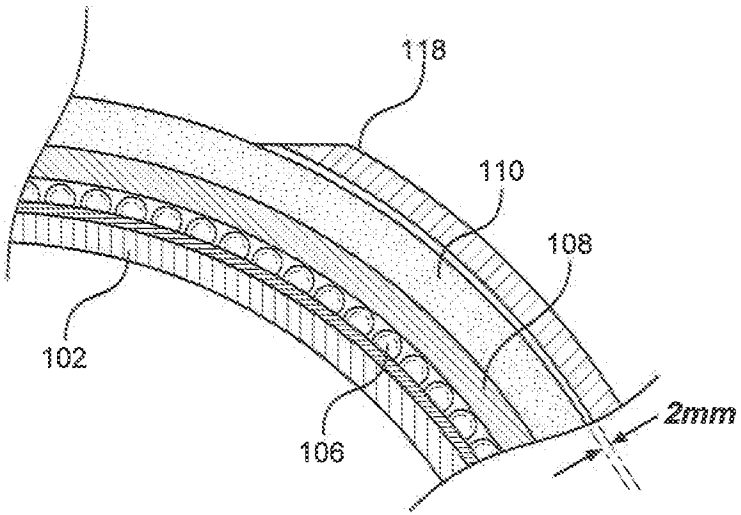
FIG. 9 is a detailed vertical cross-sectional view depicting the inner hemisphere, bearing layer, and outer hemisphere and a shroud connected through the ball bearings with rows of balls for a fixed inner hemisphere and a movable outer hemisphere, and a soft and breathable foam for a movable outer hemisphere and a shroud.

Now referring to FIG. 9, a detailed cross-sectional view of a portion of FIG. 2, depicting layers of the fixed inner hemisphere 102, ball bearings 106, the movable outer hemisphere 108, soft and breathable foam 110, and the shroud 118, is shown. The ball bearings 106 comprise rows of balls which allow the movable outer hemisphere 108 to move freely in any direction. Specifically, as shown in FIG. 9, there is a fine gap of approximately 2 mm, between the foam 110 covering the movable outer hemisphere 108, and the shroud 118. This gap prevents the movable outer hemisphere 108 and the shroud 118 from contacting each other, and minimizes the space for clothing to be pinched between the movable outer hemisphere 108 and the shroud 118. It is to be appreciated that this gap can be increased or decreased for any particular chair design, and the specific measurement of 2 mm in a preferred embodiment is not to be considered limiting.

Figure 10:
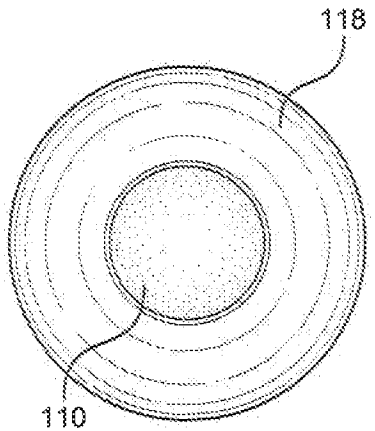
FIG. 10 is a detailed top view of the horizontally cut shroud, where a top of a soft and breathable foam is visible through the center circular cutout of the shroud.

FIG. 10 is a detailed top view for the horizontally cut shroud 118 placed on top of a medium of soft and breathable foam 110. As shown in FIGS. 9 and 10, the shroud 118 is installed on top of a medium of soft and breathable foam 110, which covers the movable outer hemisphere 108, with a fine gap of approximately 2 mm between the foam 110 and the shroud 118. This provides a soft seating surface for the user, while also providing a rigid chair structure with the shroud 118 for stability.

Figure 11:
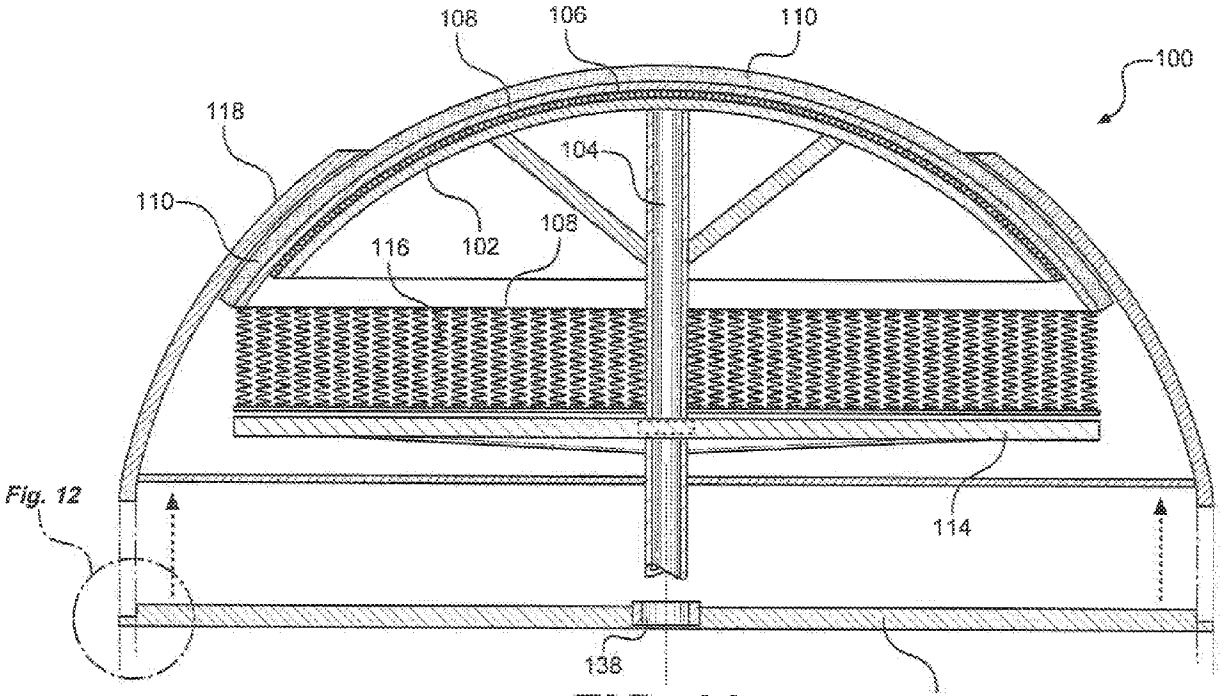
FIG. 11 is a cross-sectional view of the Ergonomic Göbelek Chair of the present invention depicting an installment of a bottom cover to the base frame of a shroud, with the support pole inserted through the circular opening on the bottom cover.
Figure 12:
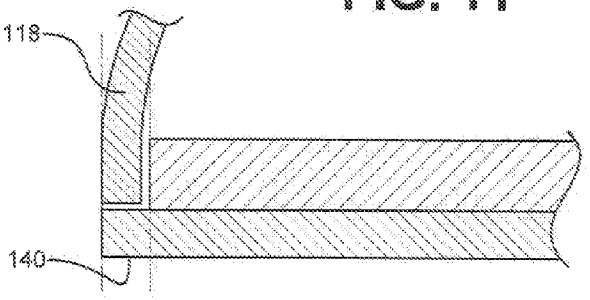
FIG. 12 is a detailed cross-sectional view of the left-end edge of the Ergonomic Göbelek Chair of the present invention shown in FIG. 11, when the outer edge of a shroud is installed to a bottom cover.

FIG. 11 is a cross-sectional view of Ergonomic Göbelek Chair of the present invention depicting an installment of a bottom cover 140 to the base frame of the shroud 118, when the support pole 104 is inserted through the circular opening 138 on the bottom cover 140. The circular opening 138 does not rotate and is placed on the bottom cover 140 for an installation of the upper part of the chair to the base part of the chair. The bottom cover 140 is made with a groove for a proper installation of the shroud 118 into the bottom cover 140. FIG. 12 is a detailed cross-sectional view of the left-end edge of the Ergonomic Göbelek Chair of the present invention, when the outer edge of the shroud 118 is installed with a bottom cover 140. As shown in FIGS. 11 and 12, the bottom cover 140 is formed with a groove at the outer edge to receive the edge of the shroud 118, and the base frame of the shroud 118 is pushed up when the bottom cover 140 is installed.

Figure 13A:
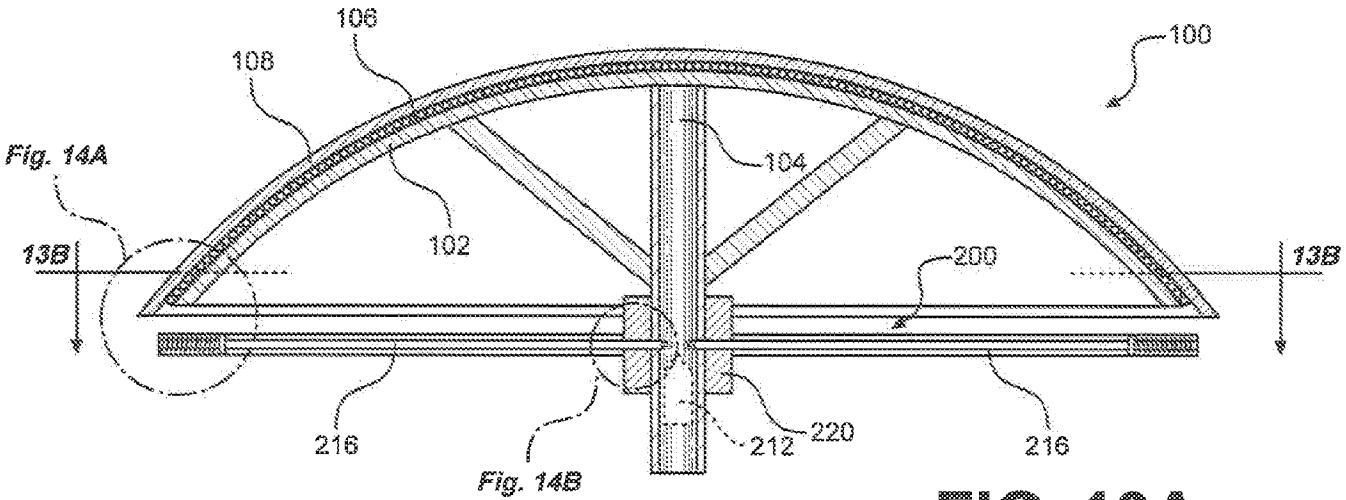
FIG. 13A is a cross-sectional view of the Ergonomic Göbelek Chair of the present invention with a support ring attached to fix the locking system to the support pole.
Figure 13B:
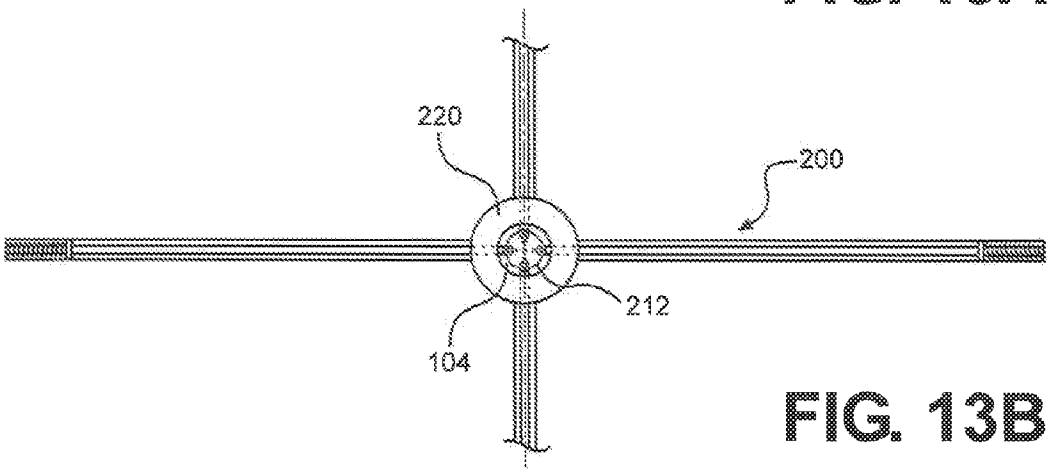
FIG. 13B is a top view of the locking system in the Ergonomic Göbelek Chair of the present invention attached to the support ring as installed on the support pole.

FIG. 13A is a cross-sectional view of the Ergonomic Göbelek Chair of the present invention depicting a support ring 220 attached to the support pole 104 to attach and fix the locking system 200. Since the locking system 200 is attached to the support ring 220 and the support ring 220 is fixedly attached to the support pole 104, when the cone shape cylinder 212 moves up forcing the locking bar shafts 216 to extend outwards underneath the movable outer hemisphere 108 to lock the movable outer hemisphere 108, the movable outer hemisphere 108 is accordingly prevented from tilting. FIG. 13B is a top view of the locking system 200 in the Ergonomic Göbelek Chair of the present invention, when it is attached to the support ring 220.

Figure 14B:
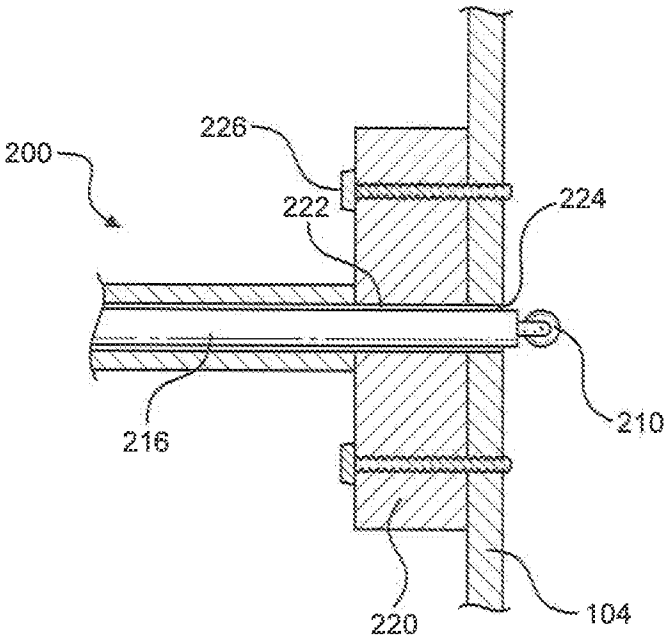
FIG. 14B is a detailed cross-sectional view of the locking system attached and fixed to the support pole through the support ring, illustrating bores extending radially outwards through the support ring and corresponding to holes formed in the support pole for such attachment.
Figure 14A:
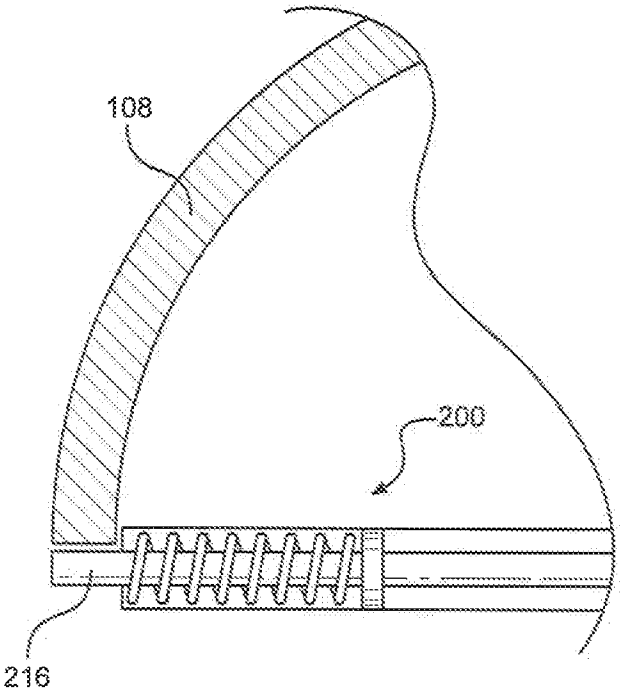
FIG. 14A is a detailed cross-sectional view of the left-end edge of the movable outer hemisphere equipped with a locking system extending underneath the movable outer hemisphere to lock the hemisphere in place to prevent movement.

FIG. 14A is a detailed cross-sectional view of the left-end edge of the movable outer hemisphere 108 shown in FIG. 13A, equipped with a locking system 200 which extends outwards underneath the outer hemisphere 108, when it is locked. As the locking bar shafts 216 in the locking system 200 extend outwards underneath the movable outer hemisphere 108, the movable outer hemisphere 108 is prevented from tilting.

FIG. 14B depicts a detailed cross-sectional view of the locking system 200 attached and fixed to the support pole 104 through the support ring 220. As shown in FIG. 14B, the tube 104 is formed with apertures 224 which align with bores 222 formed in support ring 220 such that the locking bar shaft 216 of the locking system 200 can penetrate through the support ring 220. The support pole 104 also includes a roller bearing 210 formed on the end of the bar shaft 216. The roller bearing 210 has an outer diameter that is less than or equal to the diameter of bar shaft 216 such that when the bar shaft 216 is urged outwards from tube 104, the roller bearing 210 can pass through the aperture 224 in tube 104 and into bore 222 of support ring 220. The locking system 200 is attached to the support ring 220 and the support ring 220 is further attached to the support pole 104 with an aid of screws or bolts 226.

Figure 15A:
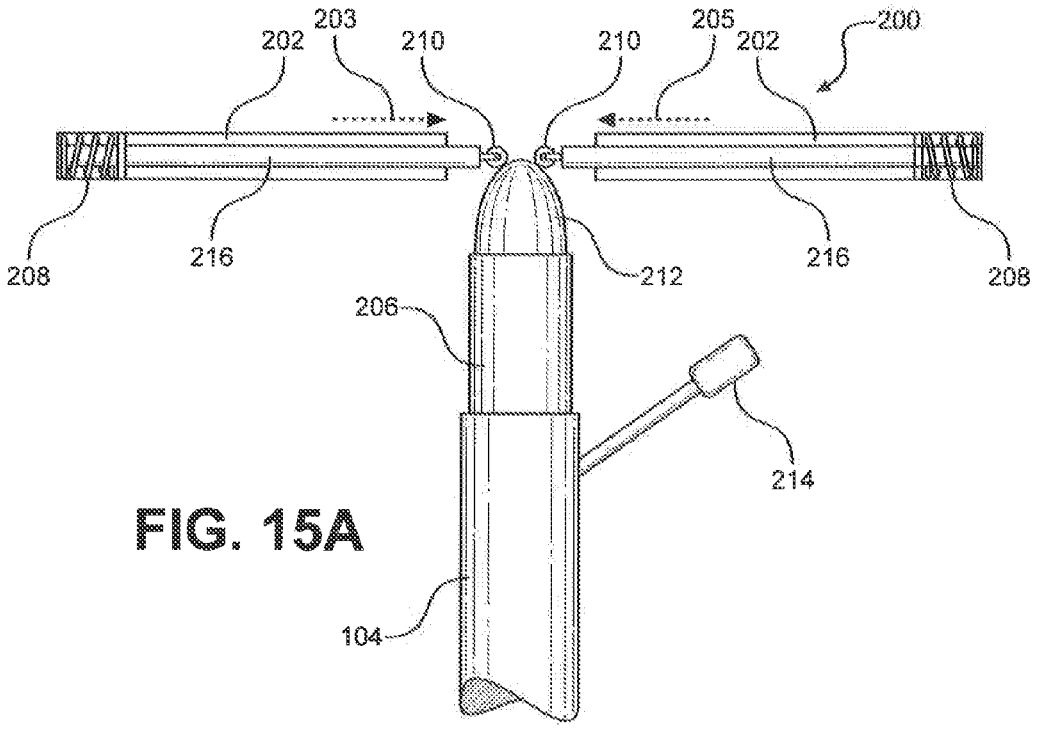
FIG. 15A is a diagrammatic view of the locking system in the Ergonomic Göbelek Chair of the present in an unlocked configuration.
Figure 15B:
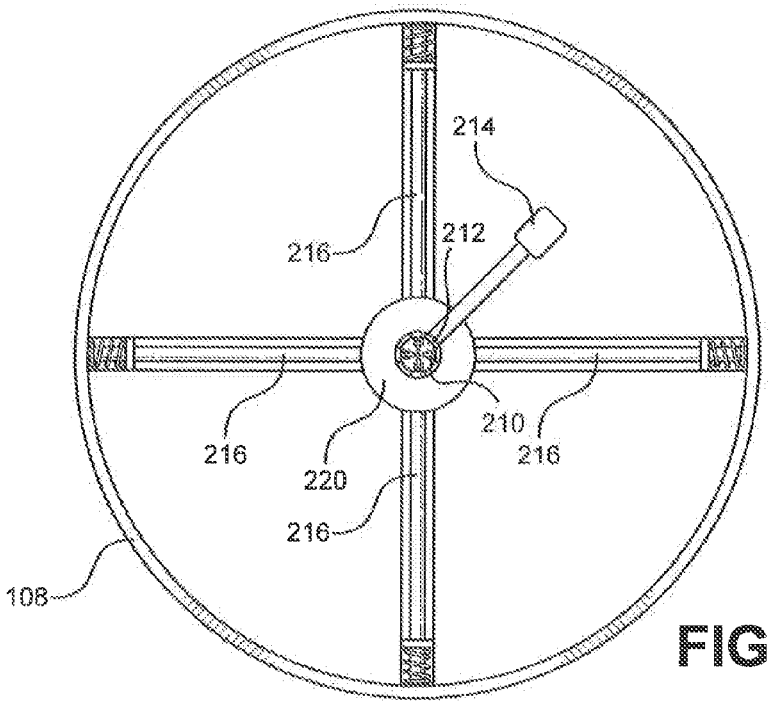
FIG. 15B is a top view of the locking system in the Ergonomic Göbelek Chair of the present invention in the unlocked configuration, illustrating the locking bar shafts pulled back into the tubing posts.

Referring to FIGS. 15A and 15B, the locking system 200 for the Ergonomic Göbelek Chair of the present invention is depicted. The locking system 200 is placed under the movable outer hemisphere 108 and primarily consists of two (2) tubing posts 202, and a cylinder cover 206. The tubing posts 202 further consist of compression springs 208 and the locking bar shafts 216 equipped inside the tubing posts 202. The locking bar shafts 216 are attached to the compression springs 208 on one (distal) end and the wheel or roller bearings 210 on the other (proximal) end. The diameter of the locking bar shaft 216 is equal or greater to that of the wheel on the wheel bearing 210. The cylinder cover 206 consists of a cone shape cylinder 212 and is inserted into the support pole 104. A locking handle 214 which is equipped on the support pole 104 moves up and down to lock or unlock the system.

Specifically, FIG. 15A is a diagrammatic view and FIG. 15B is a top view of the locking system 200 for the Ergonomic Göbelek Chair of the present invention when it is unlocked. As shown in FIG. 15A, when the locking handle 214 moves up, the cone shape cylinder 212 moves down and the system is unlocked, rendering the movable outer hemisphere 108 to move freely. As a result, in its unlocked position, the compression springs 208 urge the locking bar shafts 216 to be pulled back into the post tubing 202, in the direction of arrows 203 and 205, respectively. Therefore, in its unlocked position, as shown in FIG. 15B, there is no locking bar shaft extended underneath the movable outer hemisphere 108. In addition, as shown in FIG. 15B, the locking system 200 is attached to the support ring 220, and the support ring 220 is further attached to the support pole 104, as described above.

Figure 16A:
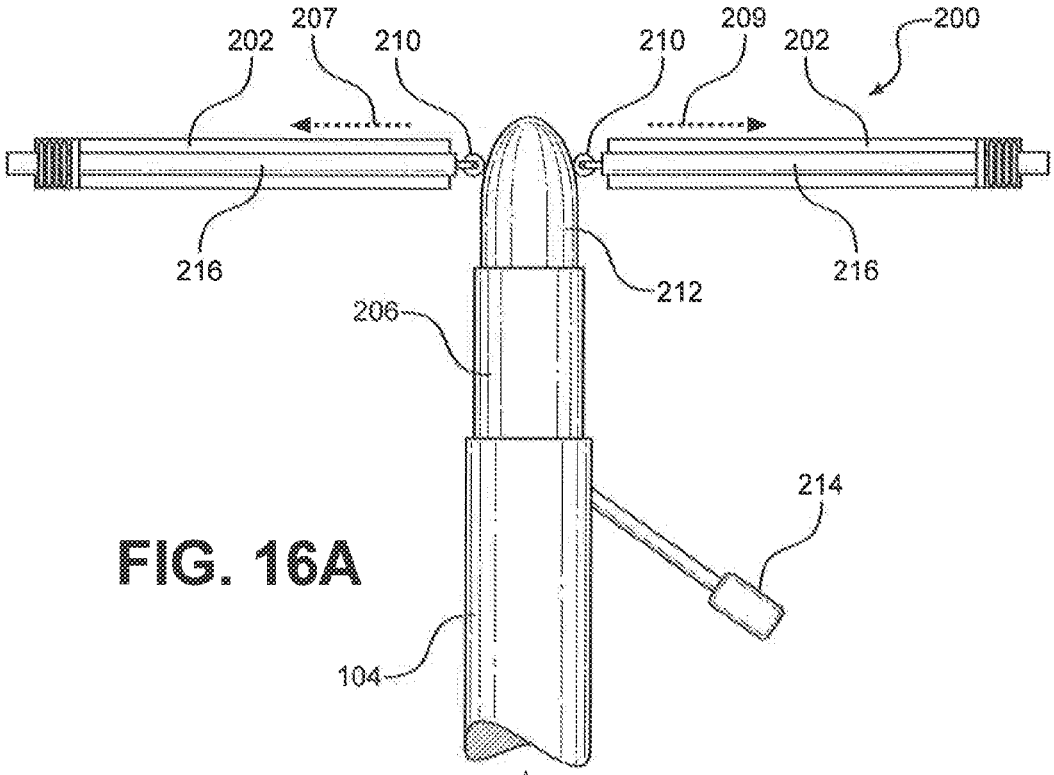
FIG. 16A is a diagrammatic view of the locking system in the Ergonomic Göbelek Chair of the present invention in a locked configuration.
Figure 16B:
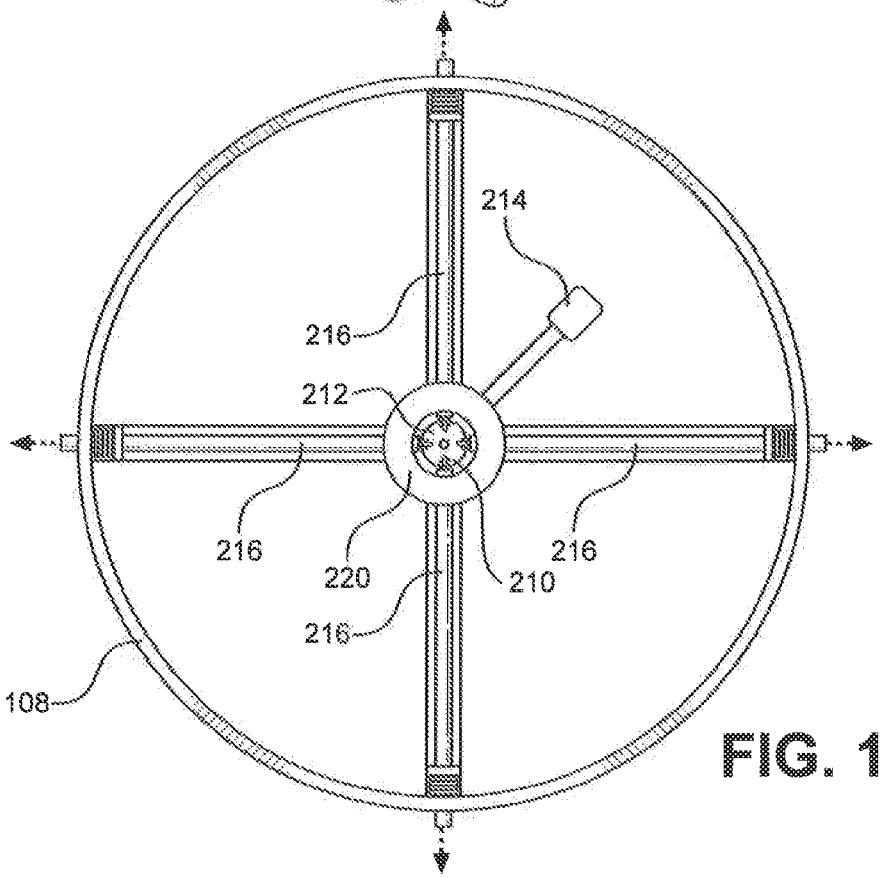
FIG. 16B is a top view of the locking system in the Ergonomic Göbelek Chair of the present invention in a locked configuration, illustrating the locking bar shafts extended underneath the movable outer hemisphere, locking the chair from tilting.

FIGS. 16A and 16B illustrate a locking system for the Ergonomic Göbelek Chair of the present invention when it is locked. As shown in FIG. 16A, when the locking handle 214 moves down, the cone shape cylinder 212 moves up forcing the locking bar shafts 216 attached to the wheel bearings 210 to be pushed out within the tubing posts 202, in the direction of arrows 207 and 209, respectively. As a result, as shown in FIG. 16B, the locking bar shafts 216 are extended under the movable outer hemisphere 108 and prevent the movable outer hemisphere 108 from tilting. As shown in FIG. 16B, the locking system 200 is attached to the support ring 220, and the support ring 220 is further attached to the support pole 104, as described above.

Figure 17:
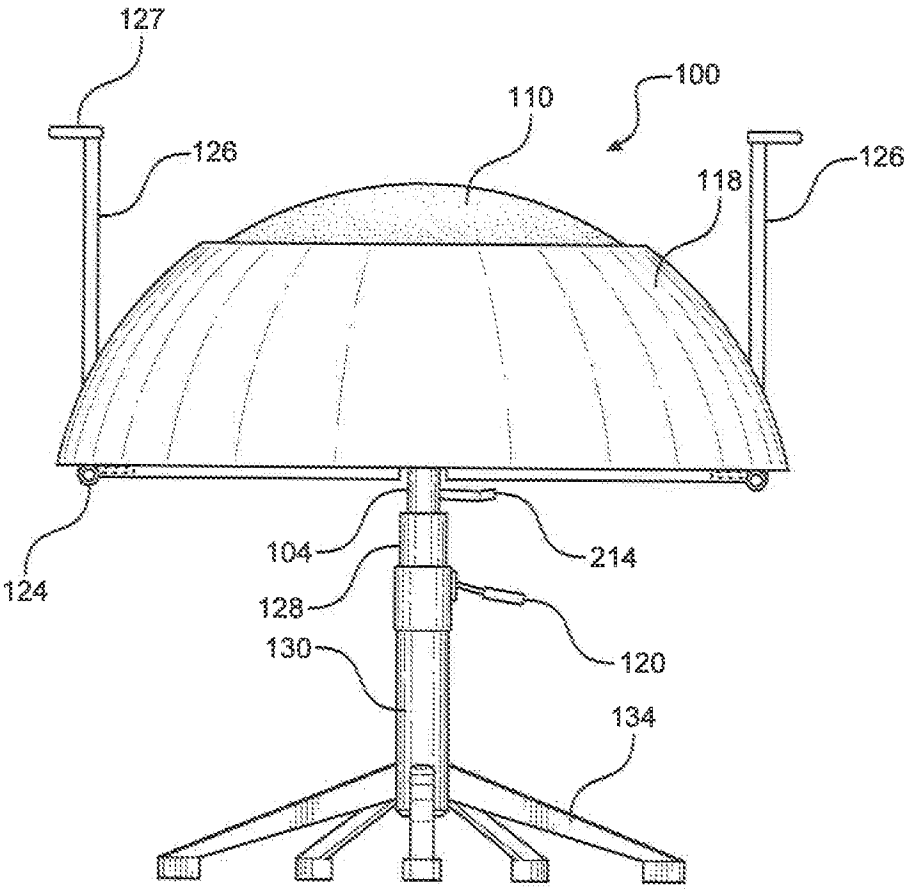
FIG. 17 is a diagrammatic view of the Ergonomic Göbelek Chair of the present invention when it is equipped with a base support having a shock absorber, a height adjustment lever, and a pedestal.

FIG. 17 depicts a diagrammatic view of the Ergonomic Göbelek Chair of the present invention with its base support 130 and a pedestal 134 equipped. A pair of the folding hinges 126 having armrest supports 127 are folded 90 degrees out in the direction 142 (shown in FIG. 2), and slid in under the chair when the chair is used as an office stretch GYM ball, or upon any other needs of the user. The folding hinges 126 can also be extended by use of an extension 129 (shown in FIG. 2) for an extra length, when the user needs longer folding hinges. The shock absorber 128 is attached to absorb any shock from an excessive load applied on the chair. The base support 130 is equipped with a height adjustment lever 120 which enables the chair to move up and down for the desirable height depending on the user's need. In addition, a locking handle 214 for the locking system 200 is equipped on the support pole 104. Selectively, a wheel assembly can be installed at the end of the pedestal 134.

Figure 18:
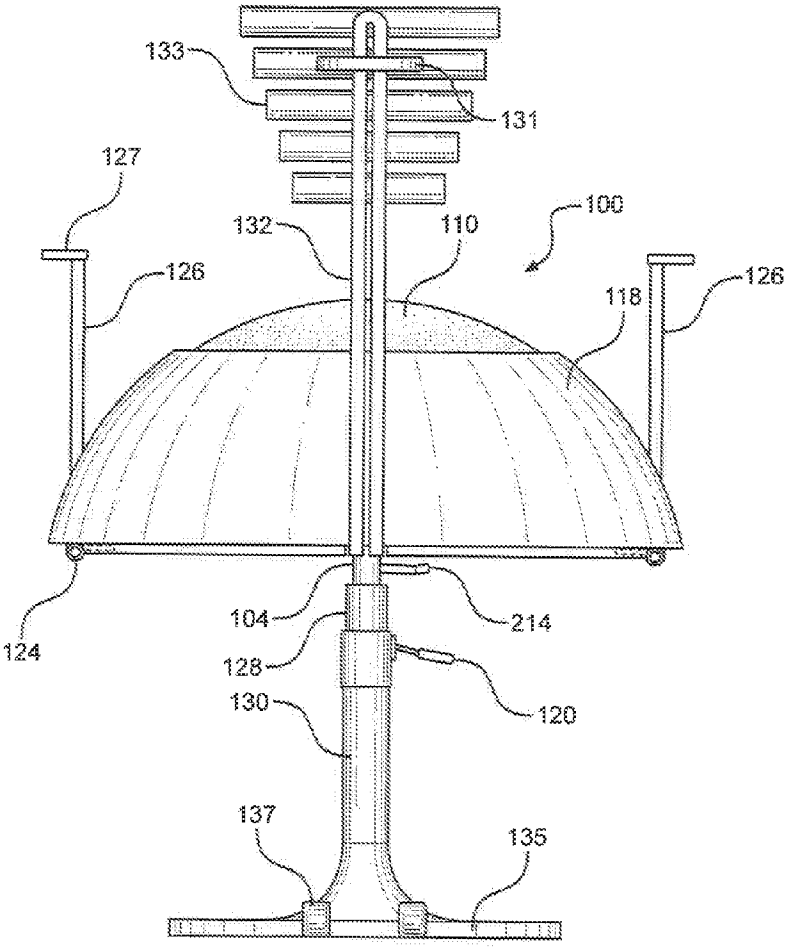
FIG. 18 is a back view of the Ergonomic Göbelek Chair of the present invention when it is equipped with an alternative pedestal having a heavy base and side wheels for easier movement of the chair when tilted.

FIG. 18 is a back view of the Ergonomic Göbelek Chair of the present invention with its base support 130 and an alternative pedestal 135 equipped. Differently from the pedestal 134 having legs described in FIG. 17, the alternative pedestal 135 may be formed with a heavy base which does not have any legs. The alternative pedestal 135 with the heavy base can provide more stability to the user when the chair does not need to be moved often, or the chair is used for over-weighted people. For easier movement of the chair with such a heavy base, a handle 131 is equipped. The handle 131 is placed at the top of a back support 132, on the back of the lumbar cushion 133. With an aid of the handle 131, the user of the Ergonomic Göbelek Chair of the present invention can tilt the heavy chair when the chair needs to be moved to some other locations. When the chair is tilted, the side wheels 137 placed on the side of the alternative pedestal 135 enable the user to easily move the chair along the ground, by a rolling movement of the side wheels 137. The use of the side wheels 137 along with the handle 131 further enables the user to move the Ergonomic Göbelek Chair of this invention along the slope.

Figure 19:
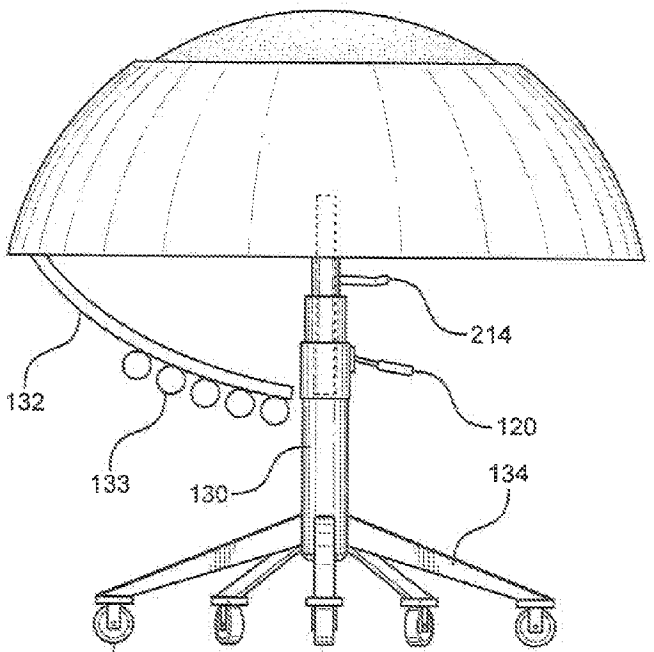
FIG. 19 is a diagrammatic view of the Ergonomic Göbelek Chair of the present invention equipped with a pedestal having wheels and a back support when the back support is positioned beneath the chair such that the Ergonomic Göbelek Chair of the present invention is used as an office stretch GYM ball.

FIG. 19 is a diagrammatic view of the Ergonomic Göbelek Chair of the present invention equipped with a back support 132. The back support 132 for the Ergonomic Göbelek Chair of the present invention is folded 180 degrees out and positioned under the chair when the chair is used as an office stretch GYM ball, or upon any other need of the user. The lumbar cushion 133 is installed on top of the back support 132 for the comfort of the user. As shown in FIG. 19, a wheel assembly 136 may be attached to the end of the pedestal 134, providing mobility of the chair.

Figure 20:
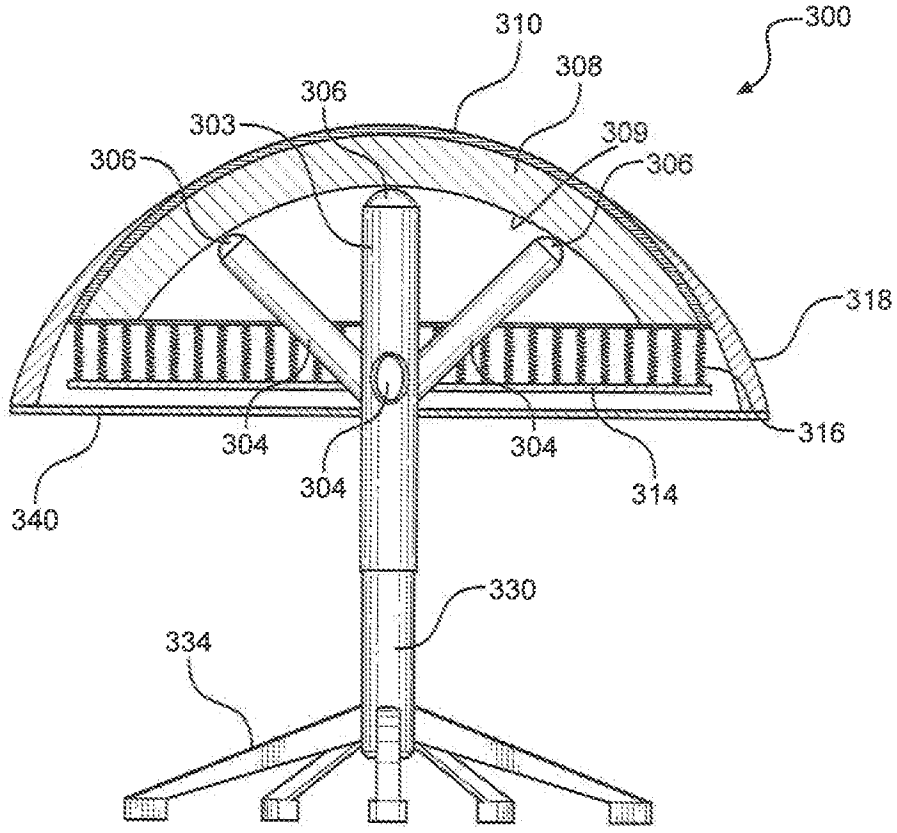
FIG. 20 is a partial vertical cross-sectional view of an alternative embodiment of the Ergonomic Göbelek Chair of the present invention when it is equipped with a shroud and a movable outer hemisphere which sits on five (5) single bearings.

FIG. 20 is a partial vertical cross-sectional view of an alternative embodiment 300 of the Ergonomic Göbelek Chair of the present invention. In the alternative embodiment 300, the Ergonomic Göbelek Chair can be equipped with a movable outer hemisphere 308 and a shroud 318, without an installation of the fixed inner hemisphere disclosed in the preferred embodiment. The movable outer hemisphere 308 simply sits on the five (5) single bearings 306. Each of the single bearings 306 is equipped with a roller within a socket to allow the movable outer hemisphere 308 to move into various directions. The inside surface 309 of the movable outer hemisphere 308 rolls along the single bearings 306 which are installed at the end of the vertical support 303 and four (4) lateral supports 304. The vertical support 303 primarily absorbs the load from the user, and may be made of materials having more strength for the structural durability and integrity of the chair. A series of tension springs 316 and a circular metal sheet 314 are also used as in the preferred embodiment. By doing so, when the movable outer hemisphere 308 rotates, the series of tension springs 316 helps the circular metal sheet 314 rotate together. Also as in the preferred embodiment, the tension springs 316 allow tension and help the movable outer hemisphere 308 move up and down and serve to maintain the orientation of the hemispherical seat during such movement.

As disclosed in the preferred embodiment, the movable outer hemisphere 308 is covered with a soft and breathable foam layer 310, which is used as a cushion for the user's comfort while sitting on the chair. The shroud 318 placed on top of a soft and breathable foam layer 310 is used as a shell for the chair and it is horizontally cut as in the preferred embodiment. At the base frame of the shroud 318, a bottom cover 340 of the chair is installed. In addition, as in the preferred embodiment, the vertical support 303 is inserted into a base support 330 which is further equipped with a pedestal 334 at its end and a height adjustment lever (not shown in FIG. 20) for the desirable height adjustment for the user.

Figure 22:
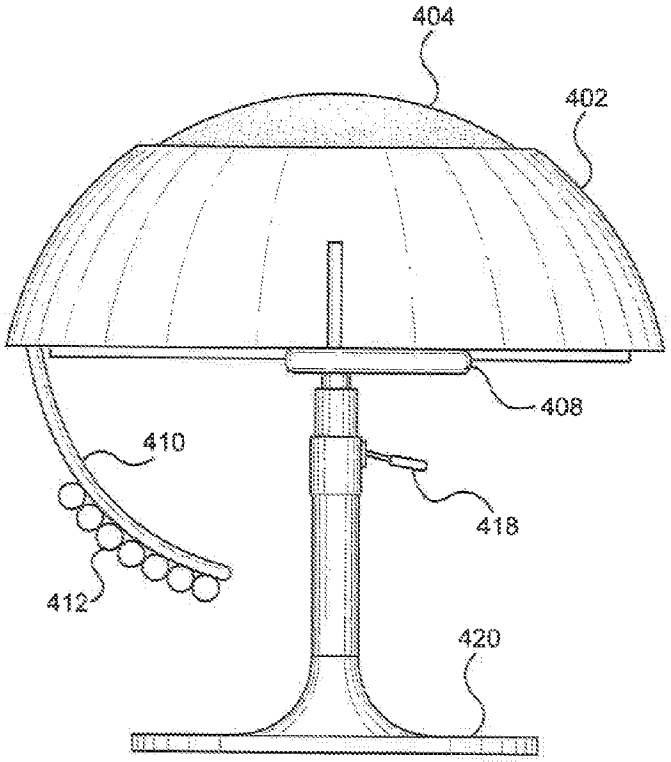
FIG. 22 is a diagrammatic view of the alternative embodiment of the Ergonomic Göbelek Chair of the present invention when the back support and the armrests are positioned beneath the chair such that the Ergonomic Göbelek Chair of the present invention is used as an office stretch GYM ball.
Figure 21:
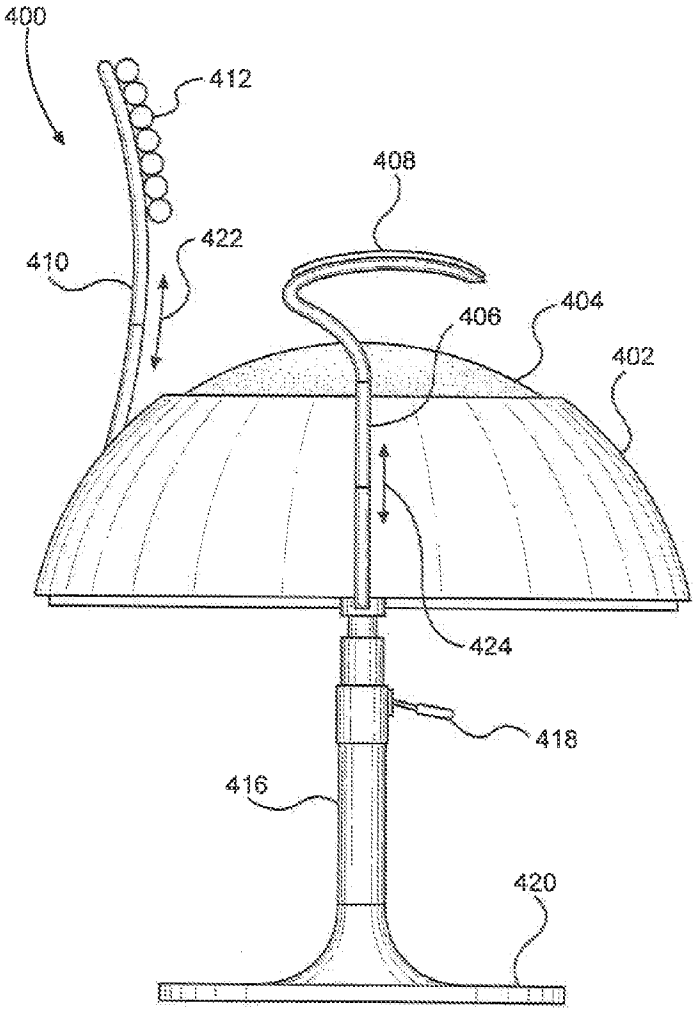
FIG. 21 is a side view of an alternative embodiment of the Ergonomic Göbelek Chair of the present invention equipped with ergonomic armrests installed with springs inside for easier movement of the armrests depending on the user's need.

Referring now to FIG. 21, a side view of an alternative embodiment of the Ergonomic Göbelek Chair of the present invention is depicted and designated 400. As shown in FIG. 21, similar to the preferred embodiment 100, the alternative embodiment 400 of the Ergonomic Göbelek Chair of the present invention is formed with a shroud 402, a sheet of soft and breathable foam 404, a back support 410 equipped with a lumbar cushion 412, a base support 416, a height adjustment lever 418 and a pedestal 420. The back support 410 is extendable in direction of arrow 422 for a desirable height of the back support 410. Specifically, the alternative embodiment 400 of Ergonomic Göbelek Chair of the present invention includes a pair of folding hinges 406 equipped with ergonomic armrests 408. The folding hinges 406 can extend in direction of arrow 424, for an adjustable height of the armrests 408 depending upon the user's desire. The ergonomic shape of the ergonomic armrests 408 can provide for more comfort when the user leans his or her arms on the armrests. FIG. 22 is a diagrammatic view of the alternative embodiment of the Ergonomic Göbelek Chair of the present invention when the back support 410 and the ergonomic armrests 408 are positioned beneath the chair. Both back support 410 and the ergonomic armrests 408 are foldable. As shown in FIG. 22, the back support 410 is folded 180 degrees out and the ergonomic armrests 408 are folded 90 degrees out to be positioned folded and slid in under the chair such that the alternative embodiment of Ergonomic Göbelek Chair of the present invention is used as an office stretch GYM ball. It is also convenient for the user of the Ergonomic Göbelek Chair of the present invention to store the chair in a smaller space by folding the back support 410 and the ergonomic armrests 408.

While there have been shown that are presently considered to be preferred embodiments of the present invention, it will be apparent to those skilled in the art that various changes and modifications can be made herein without departing from the scope and spirit of the invention.

What is claimed is:

1. An ergonomic Göbelek chair, comprising:

an inner hemisphere having a convex surface and a concave surface;

a base support having a support pole extending upward from said base support to support said inner hemisphere;

a movable outer hemisphere having a convex surface and a concave surface sized to closely receive said convex surface of said inner hemisphere, wherein said outer hemisphere is orientated adjacent said inner hemisphere;

a means for allowing the outer hemisphere to freely rotate relative to the inner hemisphere; and a means for connecting said movable hemisphere to said support pole.

2. The ergonomic Göbelek chair of claim 1, further comprising a means for locking said movable outer hemisphere wherein said movable outer hemisphere is prevented from moving with respect to the inner hemisphere when the system is locked.

3. The ergonomic chair of claim 2, wherein said means for locking is placed underneath said inner hemisphere.

4. The ergonomic Göbelek chair of claim 1, further comprising:

a pair of folding hinges having armrest supports and locking hinges, each said folding hinge having an arm pad extending from said armrest supports and configured to fold from a first position beneath said inner hemisphere to a second position wherein said arm pads are above said inner hemisphere.

5. The ergonomic Göbelek chair of claim 1, further comprising:

a back support rotatably extendable from said support pole and formed with a lumbar cushion, wherein said back support is configured to rotate 180 degrees out, said back support is positionable under the chair to be used as an office stretch GYM ball.

6. The ergonomic Göbelek chair of claim 1, further comprising a shock absorber with a height adjustment lever attached between said base support and said support pole configured to absorb any shock from an excessive load applied on said inner hemisphere and wherein said height adjustment lever is configured to allow the shock absorber to extend and retract thereby adjusting height of the chair.

7. The ergonomic Göbelek chair of claim 1, further comprising a pedestal attached to said base support.

8. An ergonomic Göbelek chair, comprising:

an inner hemisphere having a convex surface and a concave surface;

a base support having a support pole extending upward from said base support to support said inner hemisphere;

a outer hemisphere having a convex surface and a concave surface sized to closely receive said convex surface of said inner hemisphere, wherein said outer hemisphere is orientated adjacent said inner hemisphere and configured to freely move while maintaining its orientation adjacent the inner hemisphere;

a plurality of bearings between said convex surface of said inner hemisphere and said concave surface of said outer hemisphere; and a spring system connected between said movable outer hemisphere and said support pole.

9. The ergonomic Göbelek chair of claim 8, further comprises a locking system attached to said support pole, said locking system comprising:

a support ring attached to said support pole;

a plurality of tubing post attached to and extending through said support ring;

a plurality of locking bar shafts, each of said locking bar shafts having a first end fitted with a roller bearing and a second end fitted with a compression spring, wherein each of said locking bar shafts is retained within each of said tubing post with said roller bearing and said second end of said locking bar shaft protruding outside of said tubing post;

a cone shaped cylinder with a locking handle, the locking handle configured to move said cone shaped cylinder to a locked position and an unlocked position; and wherein moving said cone shaped cylinder into said locked position forces said cone shaped cylinder against said roller bearings of said plurality of locking bar shafts, wherein said each locking bar shaft is displaced along said tubing post and said second end of said locking bar shaft further protrudes outside of said tubing post, and wherein moving said cone shaped cylinder into said unlocked position allows said locking bar shafts to return.

10. The ergonomic Göbelek chair of claim 8, wherein said spring system comprises a hub attached to said support pole and a plurality of springs attached between said hub and said movable outer hemisphere.

11. The ergonomic Göbelek chair of claim 10, wherein said spring system further comprises a plurality of hydraulic resistance devices between said plurality of springs and said hub.

12. The ergonomic Göbelek chair of claim 8, wherein said spring system comprises a circular sheet having a mounting ring, said mounting ring rotatably attached to said support pole and a plurality of springs connected between said movable outer hemisphere and said circular sheet.

13. The ergonomic Göbelek chair of claim 8, further comprising:

a pair of folding hinges having armrest supports and locking hinges, each said folding hinge having an arm pad extending from said armrest supports and configured to fold from a first position beneath said inner hemisphere to a second position wherein said arm pads are above said inner hemisphere.

14. The ergonomic Göbelek chair of claim 8, further comprising:

a back support extendable from said support pole and formed with a lumbar cushion, wherein said back support is configured to rotate 180 degrees out, said back support is positionable under the chair to be used as an office stretch GYM ball.

15. The ergonomic Göbelek chair of claim 8, further comprising a shock absorber with a height adjustment lever attached between said base support and said support pole configured to absorb any shock from an excessive load applied on said inner hemisphere and wherein said height adjustment lever is configured to allow the shock absorber to extend and retract thereby adjusting height of the chair.

16. The ergonomic chair of claim 8, further comprising a pedestal attached to said base support.

17. The ergonomic chair of claim 16, wherein said pedestal further comprises wheels.

18. An ergonomic Göbelek chair, comprising:

an inner hemisphere having a convex surface and a concave surface;

a base support having a support pole extending upward from said base support to support said inner hemisphere;

a circular sheet having a mounting ring, said mounting ring rotatably attached to said support pole;

a movable outer hemisphere having a convex surface and a concave surface sized to closely receive said convex surface of said inner hemisphere, wherein said outer hemisphere is orientated adjacent said inner hemisphere;

a plurality of bearings between said convex surface of said inner hemisphere and said concave surface of said outer hemisphere; and a plurality of springs connected between said movable outer hemisphere and said circular sheet.

19. The ergonomic Göbelek chair of claim 18, further comprising:

a pedestal attached to said base support;

a shock absorber with a height adjustment lever attached between said base support and said support pole configured to absorb any shock from an excessive load applied on said inner hemisphere and wherein said height adjustment lever is configured to allow the shock absorber to extend and retract thereby adjusting height of the chair;

a pair of folding hinges having armrest supports and locking hinges, each said folding hinge having an arm pad extending from said armrest supports and configured to fold from a first position beneath said inner hemisphere to a second position wherein said arm pads are above said inner hemisphere;

a back support rotatably extendable from said support pole and formed with a lumbar cushion; and wherein said back support is rotated 180 degrees out, said pair of folding hinges having armrest supports and locking hinges is folded 90 degrees out, and both said back support and said pair of folding hinges having armrest supports and locking hinges are positionable under the chair to be used as an office stretch GYM ball.

20. The ergonomic Göbelek chair of claim 18, further comprises a locking system attached to said support pole, said locking system comprising:

a support ring attached to said support pole;

a plurality of tubing post attached to and extending through said support ring;

a plurality of locking bar shafts, each of said locking bar shafts having a first end fitted with a roller bearing and a second end fitted with a compression spring, wherein each of said locking bar shafts is retained within each of said tubing post with said roller bearing and said second end of said locking bar shaft protruding outside of said tubing post;

a cone shaped cylinder with a locking handle, the locking handle configured to move said cone shaped cylinder to a locked position and an unlocked position; and wherein moving said cone shaped cylinder into said locked position forces said cone shaped cylinder against said roller bearings of said plurality of locking bar shafts, wherein said each locking bar shaft is displaced along said tubing post and said second end of said locking bar shaft further protrudes outside of said tubing post, and wherein moving said cone shaped.

* * * * *

UNITED STATES PATENT AND TRADEMARK OFFICE

CERTIFICATE OF CORRECTION

PATENT NO. : 9,101,217 B2
APPLICATION NO. : 14/584353
DATED : August 11, 2015
INVENTOR(S) : Araz Bay It is certified that error appears in the above-identified patent and that said Letters Patent is hereby corrected as shown below:

Claims
Column 11, line 45, Claim 14, replace “back support extendable” to --back support rotatably extendable--

Signed and Sealed this
Twenty-second Day of December, 2015

Michelle K. Lee

Michelle K. Lee
*Director of the United States Patent and Trademark Office*